United States Patent [19]

O'Connor

[11] 4,121,219

[45] Oct. 17, 1978

[54] DIPOLE RESONENT LOOP ANTENNA

[76] Inventor: Gerald O'Connor, 1711 19th Ave. SE., Puyallup, Wash. 98371

[21] Appl. No.: 793,927

[22] Filed: May 5, 1977

Related U.S. Application Data

[63] Continuation-in-part of Ser. No. 675,791, Apr. 12, 1976, abandoned.

[51] Int. Cl.[2] ..... H01Q 9/26

[52] U.S. Cl. ..... 343/741; 343/803

[58] Field of Search ..... 343/741, 742, 744, 805, 343/806, 807, 803

[56] References Cited

U.S. PATENT DOCUMENTS

| | | | |
|---|---|---|---|
| 2,221,939 | 11/1940 | Bennett | 343/744 |
| 2,324,462 | 7/1943 | Leeds et al. | 343/744 |
| 2,512,725 | 6/1950 | Mock | 343/797 |

OTHER PUBLICATIONS

A.R.R.L. Antenna Book; American Radio Relay League; Newington, Conn., 1970, pp. 305, 306.

*Primary Examiner*—Eli Lieberman

*Attorney, Agent, or Firm*—Seed, Berry, Vernon & Baynham

[57] ABSTRACT

A dipole resonent loop antenna having a pair of semicircular, quarter-wave antenna elements curving away from each other in a generally circular configuration. The ends of the antenna elements are connected to each other through a pair of generally T-shaped insulative couplers having their center legs extending toward each other. A hollow boom positioned diametrically in the circular configuration has its ends secured to the center legs of the couplers. The center of the boom is then mounted on a vertical mast so that the mast extends generally along the axis of the circular configuration. A co-axial cable having a pair of conductors runs along the outside of the mast and passes into the interior of the boom through a center aperture. The conductors extend along the interior of the boom toward one of the couplers where they exit through an aperture in the outer wall of the coupler and are secured to respective antenna elements by screws passing through the coupler and the antenna elements.

3 Claims, 4 Drawing Figures

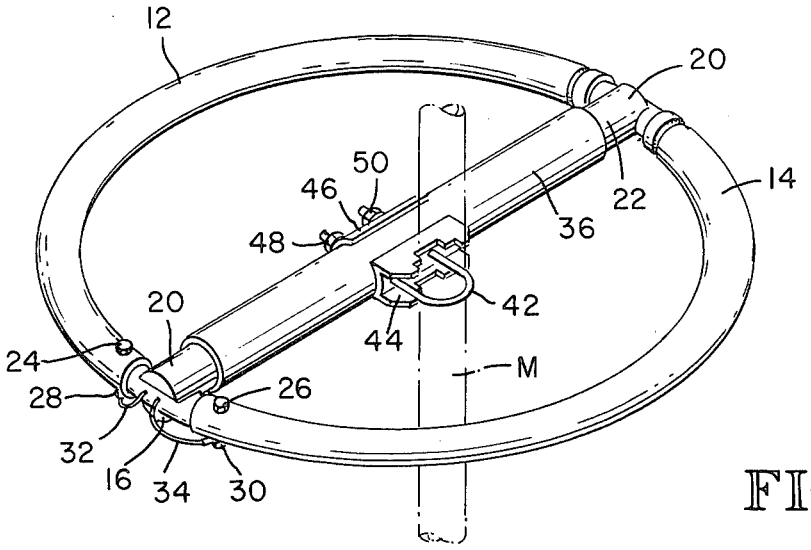
FIG. 1
FIG. 2
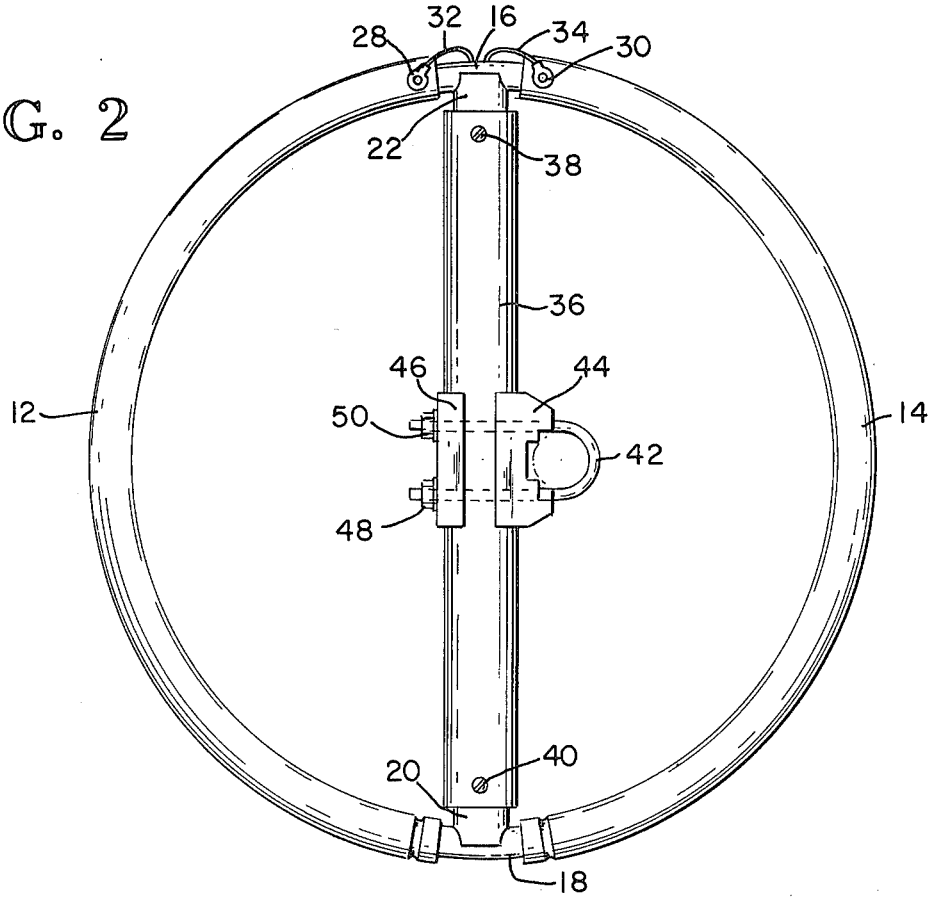

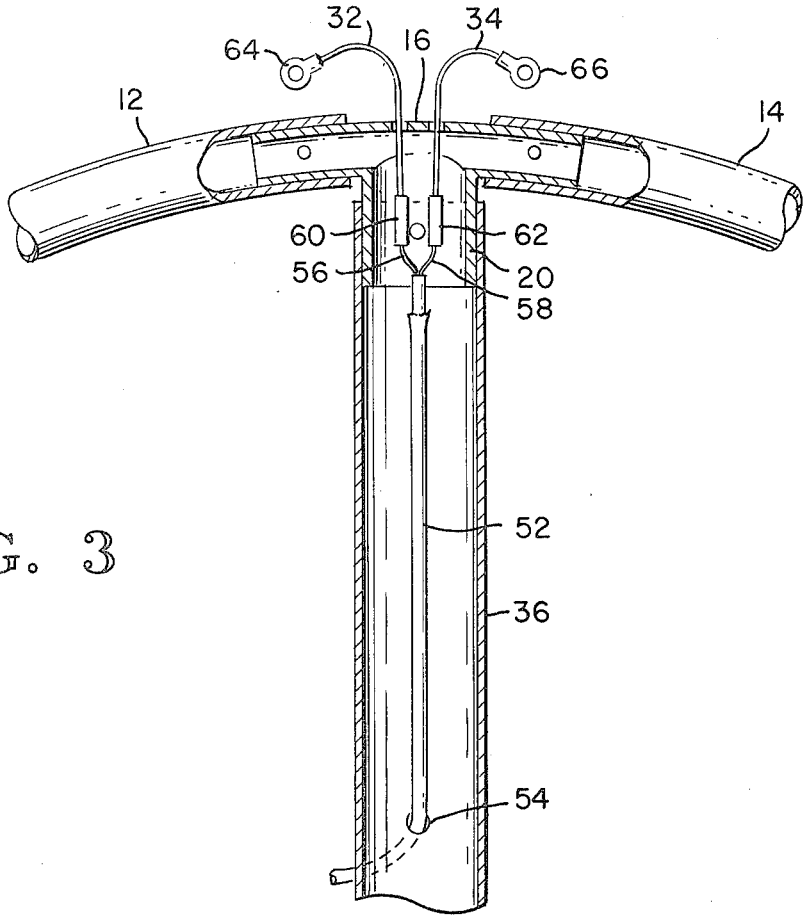
FIG. 3
FIG. 4
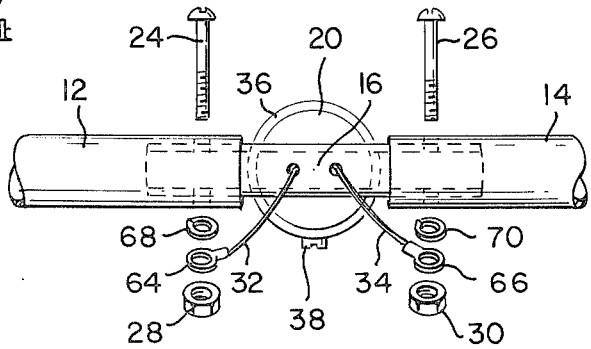

DIPOLE RESONENT LOOP ANTENNA

This is a continuation-in-part of application Ser. No. 675,791, filed Apr. 12, 1976, now abandoned.

BACKGROUND OF THE INVENTION

1. Field of the Invention

This invention relates to antennas, and, more particularly, to a nondirectional, compact and rugged half-wave dipole antenna.

2. Description of the Prior Art

The most fundemental antenna is the dipole, or half-wave dipole antenna. Dipole antennas employ a linear conductor disposed substantially parallel to the ground which is driven from its center so that its ends are permitted to resonate. There are a wide variety of modifications to this structure including a single conductor folded to form multiple sections which are parallel to each other and ground, and parallel matching conductors which are driven in various arrangements. The sensitivity of such antennas can be increased either by increasing the collector area, by arranging the dipole antenna and in an array, or by providing the antenna with reflectors. Any of these alternatives are inconsistent with the requirements of compactness which is demanded in a mobile antenna, and the later alternatives increase the directivity of the antenna pattern which is usually undesirable for mobile antennas.

One antenna structure which is sufficiently sensitive and compact to be advantageously employed as a mobile antenna is the loop or halo antenna. However, such loop antennas are somewhat directional so that they are not particularly suited to mobile operation since the orientation of the vehicle with respect to the signal source results in intermittent reception.

SUMMARY OF THE INVENTION

It is an object of the invention to provide a half-wave dipole antenna which is extremely compact and rugged so that it may be advantageously used for mobile applications.

It is another object of the invention to provide a half-wave dipole antenna which is relatively uni-directional so that reception of a signal is not affected by variations in the orientation of the antenna.

It is still another object of the invention to provide a half-wave dipole antenna which has relatively small material and fabrication costs in view of its superior operating characteristics.

It is a further object of the invention to provide a mounting structure for a loop antenna which dampens vibration induced modulation of the received signal.

These and other objects of the invention are accomplished by a pair of semi-circular, spaced apart, quarter-wave antenna elements which are connected to each other end to end with the elements curving away from each other in a generally circular configuration. The elements are secured about an elongated, electrically conductive mast with the mast extending along the approximate axis of the circular configuration so that the mast does not cause the antenna to have a horizontally directional pattern. The ends of the antenna elements are preferably connected to each other through a T-shaped insulative coupler positioned so that the center legs of the couplers extend toward each other. The ends of a boom diametrically positioned within the circular configuration are then secured to respective center legs of the couplers, and the center of the boom is secured to the support mast.

BRIEF DESCRIPTION OF THE DRAWINGS

FIG. 1 is an isometric view illustrating the half-wave dipole resonant loop antenna mounted on an electrically conductive mast.

FIG. 2 is a bottom plan view of the antenna illustrated in FIG. 1.

FIG. 3 is a fragmatic cross-sectional view of the antenna illustrating the manner in which a pair of co-axial conductors are positioned within the antenna and secured to the antenna elements.

FIG. 4 is an exploded, side elevational view illustrating the manner in which the conductors are secured to the antenna elements, and the antenna elements are secured to an insulated, T-shaped coupler.

DETAILED DESCRIPTION OF THE PREFERRED EMBODIMENT

With reference to the drawings, and more particularly to FIGS. 1 and 2, the dipole resonant loop antenna comprises a pair of semi-circular, electrically conductive antenna elements 12,14 which curve away from each other in a substantially circular configuration. Since the ends of the antenna elements 12,14 are spaced apart from each other the elements 12,14 are electrically isolated from each other. The antenna elements 12,14 are approximately one quarter wave length at the operating frequency of the antenna. As with conventional antennas of other designs, it has been found that the actual length of the antenna elements 12,14 will not be exactly equal to the theoretically optimum length since the optimum length depends upon the thickness of the elements in relation to the wave length. Although the antenna elements 12,14 may be formed from a variety of materials, hollow tubing of aluminum has been advantageously used since it is relatively inexpensive, light in weight and resistant to weather deterioration.

The adjacent ends of the antenna elements 12,14 are preferably secured to the opposing legs of generally T-shaped couplers 16,18 fabricated of an insulative material such as plastic with the center legs 20,22 of the couplers 16,18 respectively facing toward each other. One of the couplers 18 is secured to the antenna elements 12,14 by placing the ends of the antenna elements 12,14 over the opposing legs of the coupler 18 and crimping in place at 24,26 so that the antenna elements 12,14 are frictionally secured to the coupler 18. The opposing legs of the remaining coupler 16 are inserted into the adjacent ends of the elements 12,14 and secured thereto by screws 24,26 extending through the elements 12,14 and coupler 16, and fastened in place by nuts 28,30, respectively. As explained hereinafter, the screws 24,26 and nuts 28,30 are used to connect the antenna elements to respective electrical conductors 32,34. An elongated boom 36 diametrically positioned within the circular configuration formed by the antenna elements 12,14 extends between the center legs 20,22 of the couplers 16,18, respectively. The ends of the boom 36 enclose the center legs 20,22 and are secured thereto by sheet metal screws 38,40 (FIG. 2) which are preferably stainless steel in order to minimize the corrosive effects of a salt water environment. The boom 36 may be fabricated from either a conductive material such as aluminum or a nonconductive material such as plastic. A material such as plastic is preferred since it has a tendency to dampen vibrations which occur when the antenna is mounted on a moving vehicle or vessel. The vibrations can amplitude or phase modulate the received signal thereby degrading the quality of the received signal. The center of the boom 36 is secured to an electrically conductive mast M by a U-bolt 42 mounted on the boom 36 with brackets 44,46 and secured in place by bolts 48,50. Since the mast M extends along the approximate axis of the circular configuration formed by the antenna elements 12,14 it does not alter the antenna pattern as with conventional antennas of this structure having other mounting means so that the horizontal pattern of the antenna is substantially omnidirectional.

As best illustrated in FIGS. 1 and 3, a co-axial cable 52 extends upwardly along the outside of the mast M and passes into the interior of the boom 36 near its center through an aperture 54. The cable 52 runs along the inside of the boom 36 toward the coupler 16 where its conductors 56,58 are crimped to conductors 32,34 by tubular metallic fasteners 60,62, respectively The conductors 32,34 terminate in respective annular contacts 64,66 of conventional variety. As best illustrated in FIG. 4, the screws 24,26 pass through the antenna elements 12,14, and respective lock washers 68,70 are placed over their ends. Finally, the contacts 64,66 are placed over the washers 68,70, respectively, and secured in place by the bolts 28,30. Thus the screws 24,26 are utilized to connect the conductors 32,34 to the elements 12,14 as well as to secure the coupler 16 to the elements 12,14.

The electrical characteristics of the cable 52 must be selected to maintain a reasonable standing wave ratio in the cable 52. The characteristic impedance of the cable 52 preferably matches the relatively low impedance of the antenna as well as the impedance of the electrical device (not shown) connected to the cable 52. Alternatively, an impedance matching transformer (not shown) may be mounted inside the boom 36 and connected between the co-axial cable 52 and the antenna elements 12,14.

The inventive half-wave dipole resonant loop antenna employed in a mobile application may often be used in a marine environment where it is subject to the corrosive effects of salt water. Consequently, the antenna must be constructed to prevent electrolytic deterioration of its component in a salt water environment. The screws 24,26,38,40, washers 68,70, and nuts 28,30 must be of a material such as stainless steel which will not produce electrolysis when exposed to a salt water environment. This is particularly true where the contacts 64,66 are copper and the antenna elements 12,14 are aluminum since the contacts 64,66 must be separated from the antenna elements 12,14 by the washers 68,70.

The inventive antenna is thus a relatively inexpensive, compact and rugged half-wave dipole antenna which may be mounted on an upstanding electrically conductive mast to provide a horizontally omni-directional antenna pattern which will allow signal reception regardless of the position of the antenns.

I claim:

1. A half-wave dipole resonant loop antenna, comprising:

a pair of semi-circular, spaced apart, quarter-wave antenna elements;

a pair of generally T-shaped insulative couplers each of which has a pair of opposed legs extending away from each other and a center leg projecting perpendicularly away from said opposed legs, each of said opposed legs being secured to respective antenna elements with said center legs extending toward each other such that said elements curve away from each other in a generally circular configuration;

an upstanding, elongated, electrically conductive support mast; and an electrically non-conductive elongated boom positioned diametrically within said circular configuration, said boom having its ends secured to the respective center legs of said couplers and its midportion secured to said support mast.

2. The antenna of claim 1 wherein said boom is tubular and wherein co-axial conductors are secured to said antenna elements through separate lead conductors which are connected to said co-axial conductors by respective tubular crimps positioned within said boom such that said boom shields said crimps from moisture thereby preserving the electrical connections between said co-axial conductors and respective lead conductors.

3. The antenna of claim 1 wherein said boom is fabricated from a resilient material having a relatively high damping coefficient such that said boom dampens vibrations thereby minimizing vibration induced modulation of said signal.

* * * * *